US005193465A

United States Patent [19]

Delaye et al.

[11] Patent Number: 5,193,465

[45] Date of Patent: Mar. 16, 1993

[54] TABLE ASSEMBLY WITH CIRCUMFERENTIALLY DISPOSED RETRACTABLE EXTENSION MEMBERS

[76] Inventors: Régis Delaye, 12, avenue de Madrid, 92200 Neuilly; Gaston Lapierre, Rue de l'Armée d'Afrique, 13830 Roquefort la Bedoule, both of France

[21] Appl. No.: 846,726

[22] Filed: Mar. 2, 1992

Related U.S. Application Data

[63] Continuation of Ser. No. 493,741, Mar. 15, 1990, abandoned.

[30] Foreign Application Priority Data

Mar. 17, 1989 [FR] France ..... 89 03556

[51] Int. Cl.[5] ..... A47B 1/00

[52] U.S. Cl. ..... 108/66; 108/69

[58] Field of Search ..... 108/66, 65, 69, 73, 108/44, 78, 77, 124, 90; 248/286, 280.4, 280

[56] References Cited

U.S. PATENT DOCUMENTS

| | | | |
|---|---|---|---|
| 5,667 | 11/1873 | Bennor | 108/78 |
| 134,904 | 1/1873 | Loth | 108/78 |
| 1,079,099 | 11/1913 | Booker | 108/66 |
| 1,411,741 | 4/1922 | Merdzinski | 108/66 |
| 4,142,967 | 1/1981 | Leonhart | 108/69 X |
| 4,646,654 | 3/1987 | Sullivan | 108/66 X |
| 4,836,114 | 6/1989 | Cohen et al. | 108/66 |

FOREIGN PATENT DOCUMENTS

| | | | |
|---|---|---|---|
| 267794 | 1/1969 | Austria | 108/66 |
| 1267224 | 6/1961 | France | 108/78 |
| 105273 | 12/1964 | Norway | 108/65 |
| 789624 | 1/1958 | United Kingdom | 108/78 |

*Primary Examiner*—Jose V. Chen

*Attorney, Agent, or Firm*—Burns, Doane, Swecker & Mathis

[57] ABSTRACT

The disclosure relates to a table assembly with circumferentially disposed retractable extension members. The extension members, when not in service, are vertically stored beneath the table plate in radially space relationship with each other. On purpose to facilitate such a storing, each extension member is articulated to the table plate by a hinge-slider assembly.

12 Claims, 4 Drawing Sheets

TABLE ASSEMBLY WITH CIRCUMFERENTIALLY DISPOSED RETRACTABLE EXTENSION MEMBERS

This application is a continuation of application Ser. No. 493,741, filed Mar. 15, 1990 now abandoned.

BACKGROUND AND STATEMENT OF THE INVENTION

The present invention relates to a table assembly provided with a plurality of circumferentially disposed rectractable extension members.

This kind of table having an attractive appearance is known but has not been commercially developped. In fact the extension members which are substantially annular shaped are not very easy to store.

One object of the present invention is to obviate this drawback by means of a table assembly so arranged as to enable said extension members to be vertically stored radially spaced apart at equal distance from each other under the table plate, when said members are not serviced.

Another object of the invention is to provide a table assembly so arranged as to enable, when an extension member is coplanar to the table plate, said member to be unlocked and then to be pivoted downwards by 90° C. about a virtual axis closely related to the lower edge of one of its rectilinear sides, whereupon said member is moved towards the table central area until the external edge of the major annular side thereof attains at least the edge of the circular side of the table plate. In this position, said extension member which is vertically and radially located has one of its rectilinear sides wholly adjacent to the lower surface of the table plate.

Therefore this invention relates to a table assembly comprising a plurality of retractable extension members which are, when unstored, circumferentially disposed in coplanar relationship with a polygonal or circular table plate mounted on supporting means, each retractable extension member being either annular or polygonal-shaped section, wherein on purpose to enable said extension members to be mounted in service and then dismounted as to be retracted for storage under the table plate where they are vertically and radially spaced apart at equal distance from each other, the major curved side being externally located whereas one of the rectilinear sides is adjacent to the lower surface of the table plate, provision has been made on each extension member for means enabling on one hand, each extension member to be radially translated with respect to the table central portion and, on the other hand, to be pivoted either to a spread out position where said member is held in coplanar relationship to the table plate by holding means or to a vertical position wherein after having retracted the holding means said extension member is locked into locking means provided to this end.

The table assembly of this invention is also remarkable by the following points:

the locking means consist of recesses formed in the plate supporting means, i.e. the central column and/or the basement of the table, so that during the motion of the extension member toward the central portion of the table, the lower end portion of each extension member is engaged into the corresponding recess which acts as a guiding means during the inward motion of said member and as holding abutment means when said inward motion is completed.

the rectilinear side of each extension member which is, after having been radially moved, adjacent to the lower surface of the table plate is articulated to said plate by said translating/pivoting means which enable on the one hand, each extension member to be downwardly rotated by 90° from the vertical position thereof and, on the other hand, to be moved towards the plate central portion.

said translating/pivoting means comprise on the lower surface of each extension member an axle mounted along the lower edge of the corresponding rectilinear side and extending into a hollow member affixed on the lower surface of the table plate.

The hollow member is provided with a longitudinal lateral recess on groove which may be open or closed and enables, as the extension member is translated, the axis/extension member junction linear portion to pass through.

Stopping means are provided at the end portion of the axle toward the table central area on purpose to hold each extension member in close relationship to the table plate when said member is horizontally oriented, while enabling the outward motion of said member when it is vertically oriented on purpose to face the longitudinal groove of the hollow member as the extension member is properly pivoted, thus enabling, when said groove is open, the extension member to be radially moved and subsequently dismounted. The stopping means may be shaped as a removable pin on purpose to be dismounted when said groove is closed.

According to an alternative embodiment, the means for locking the extension members when the latter have to be stored comprises an assembly of guiding radial members spaced from each other by 60°, and cooperating with sliding elongated members affixed to the relative extension member, said assembly being mounted on the top portion of the table supporting member.

Thus the translating/pivoting means are substantially intended to easily drive each extension member from the horizontal position thereof, in coplanar relationship to the table plate, to a vertical position by a rotating motion and then by a translating motion.

DETAILED DESCRIPTION OF THE INVENTION

Figure 1:
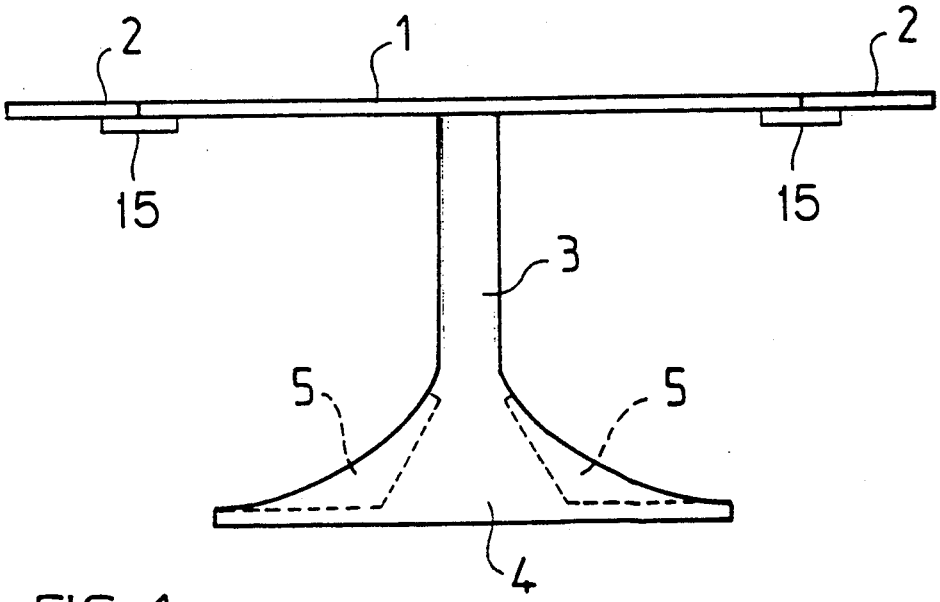
FIG. 1 is an elevation view of a table assembly with the extension members in coplanar relationship with the table plate.

With reference to FIG. 1, there is shown the general configuration of the inventive table assembly with the circular plate 1, the extension members 2 spread out, the central support column 3 secured to the basement 4 on which are shown in dotted lines the guiding recesses 5.

Figure 2:
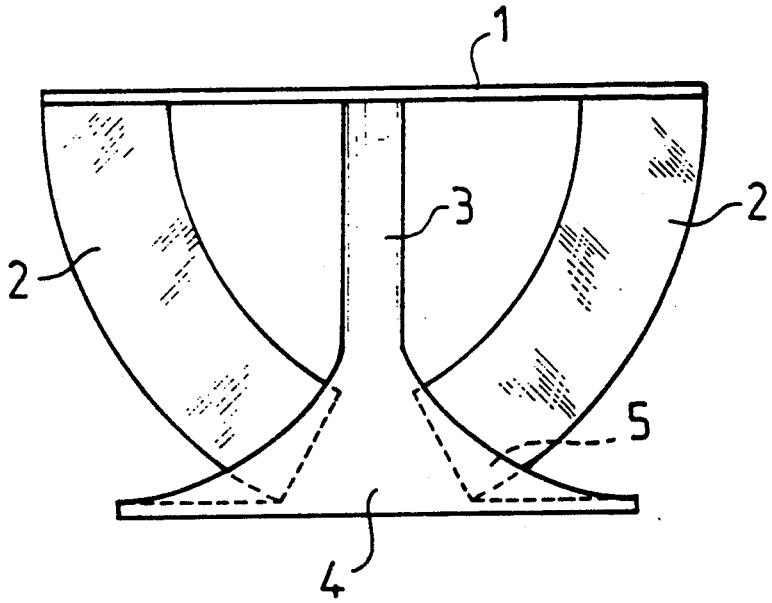
FIG. 2 is an elevation view of the table assembly shown in FIG. 1, the extension members being stored under the table plate.

Identical members are also shown in FIG. 2, the extension members 2 being however stored with one of their respective rectilinear sides adjacent to the lower surface of the plate whereas the other rectilinear side is engaged into the relative guiding recess 5.

Figure 3:
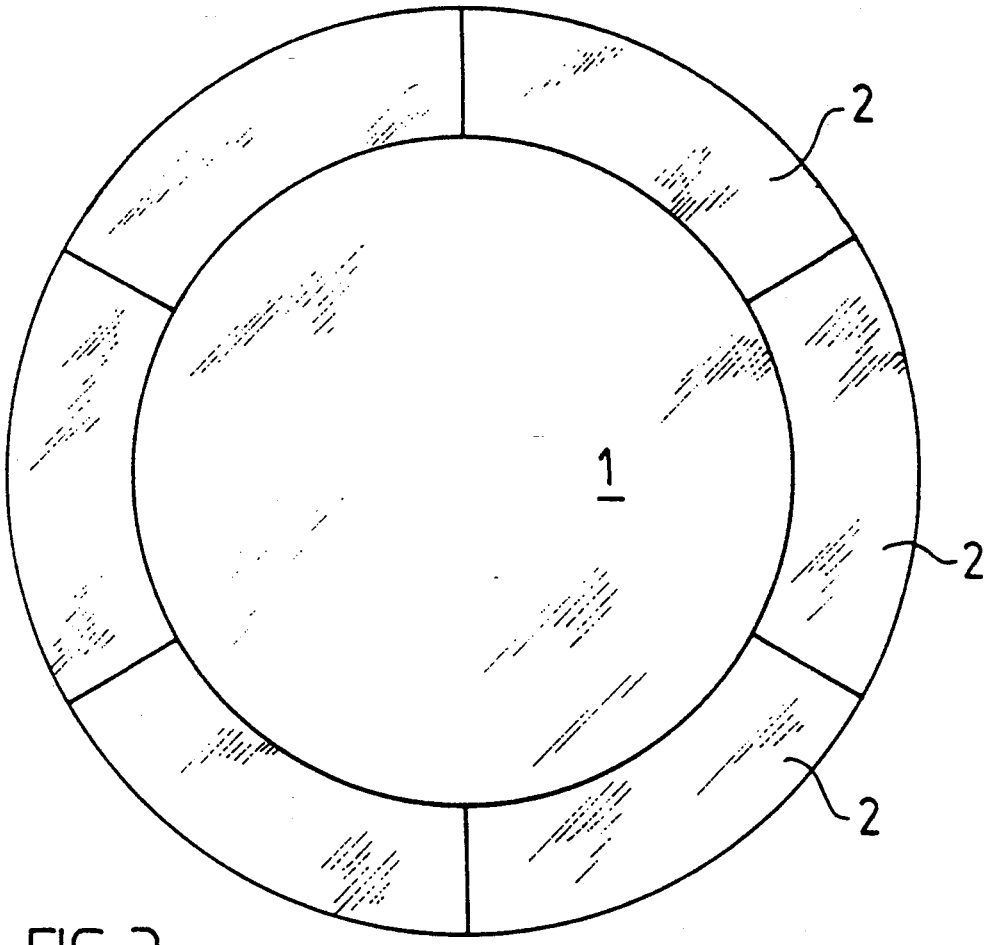
FIG. 3 is a top view of the plate with the whole extension members spread out.

In FIG. 3 the whole extension members 2 are located as to form an entire ring around plate 1.

Figure 4:
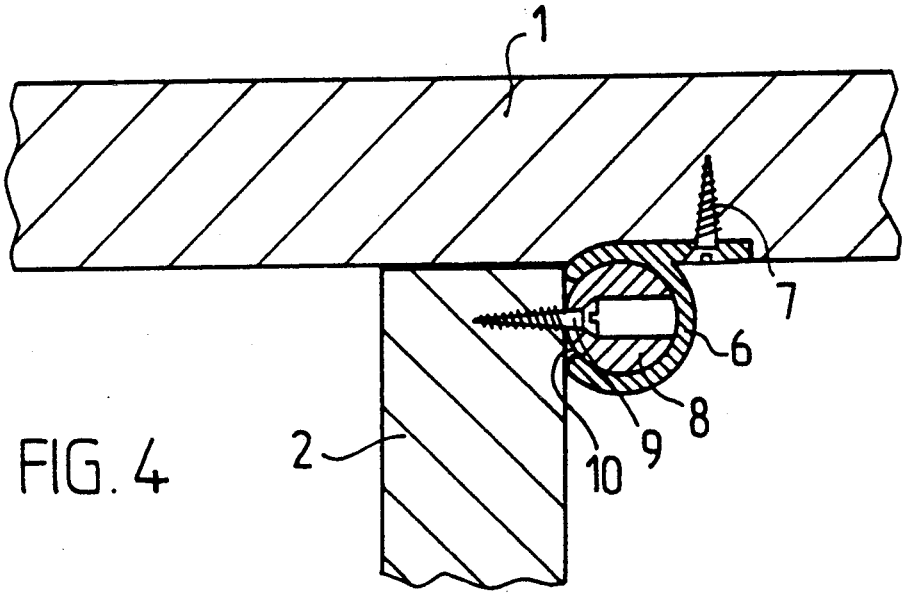
FIG. 4 is a cross-sectional view of the hinge-slider mechanism showing the affixing thereof onto the plate extension member assembly.

In FIG. 4, there is particularly shown the configuration and the mounting of the hinge-slider assembly. The pivoting axle 8 is secured to extension member 2 by the screw 9. This axle is able to pivot within tube 6 which is secured to plate 1 by means of screw 7. Said axle is able to slide along tube 6 provided with a longitudinal slot 10 along which is sliding a stud 16 firmly secured at the freeend of axle 8.

Figure 5:
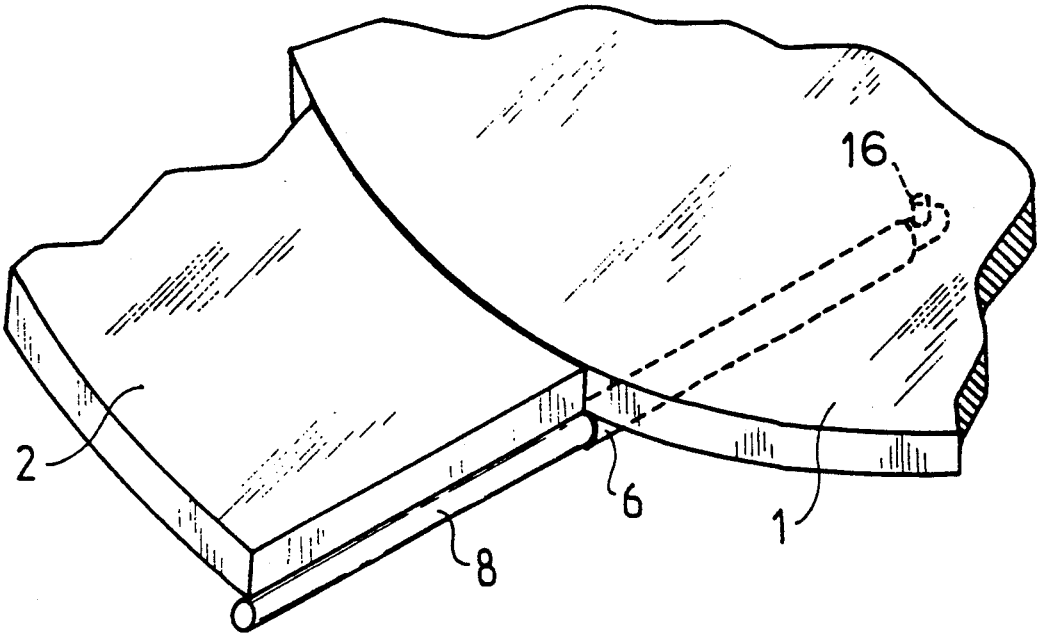
FIG. 5 is a perspective view of the hinge-slider mechanism when the respective extension member is in coplanar relationship to the table plate.

In FIG. 5, there is shown an extension member 2 in coplanar relationship to the table plate 1. Axle 8 is affixed onto the lower surface of said member 1 and extends therefrom toward the table central portion. The stopping pin 16 holds the relative extension member 2 in close relationship to plate 1.

Figure 6:
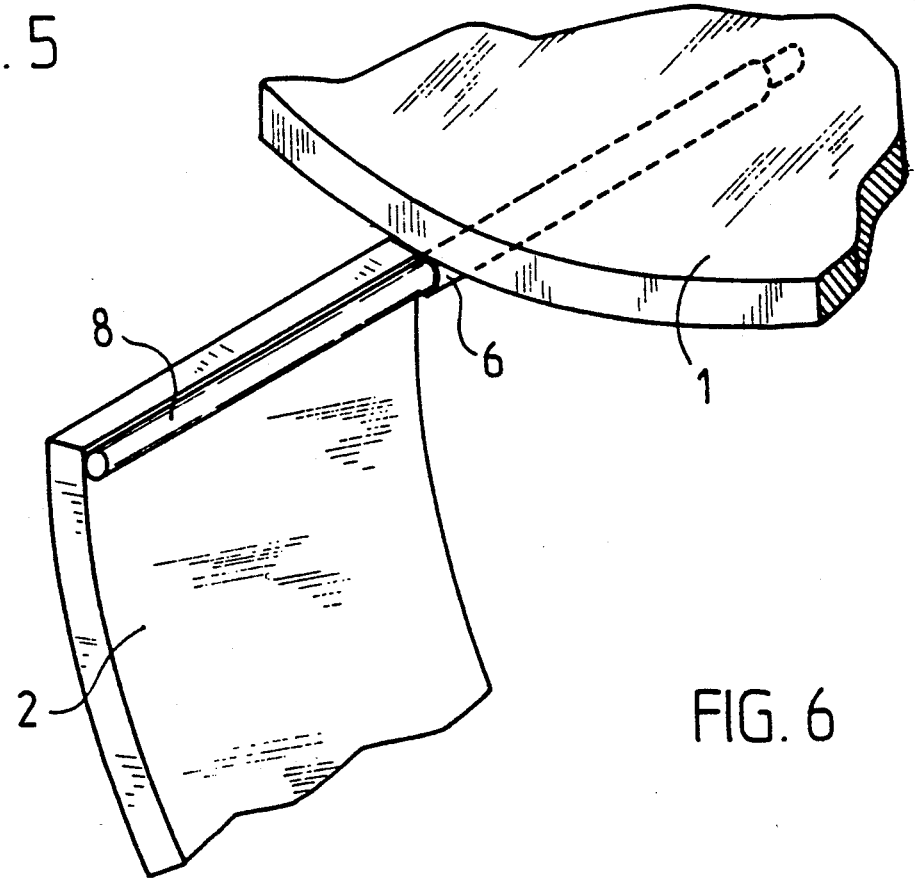
FIG. 6 is a perspective view of the members illustrated in FIG. 5 when the extension members have been pivoted downward by 90°.

In FIG. 6, the extension member yet illustrated in FIG. 5 has been pivoted by 90° on purpose to be translated under plate 1. In said position, said member may be also moved outwardly when, for example slot 10 in tube 6 extends along the whole length thereof, so that stud, which has to be previously pivoted as to face slot 10, could slide along the latter, thus enabling said extension member to be dismounted.

From the foregoing, it would be obvious that axle 8 and tube 6 into which said axle may rotate, form together a conventionnal hinge assembly.

Further when an extension member 2 is mounted coplanar to plate 1, axle 8 which is moved from the external curved edge of said extension member along the rectilinear edge of the latter and enters the tube 6 comes in abutment with a stopping pin and can no longer slide away from the table plate. By means of the mechanism hereinbefore described, it is therefore easy to pivot the extension member 2 downwardly by 90° about axle 8. As to enable said extension member 2 to be then moved towards the central portion of the table plate, the tube 6 is provided, as hereinabove stated, with a longitudinal side groove or slot 10 so as to enable the extension member/axle junction line to pass therethrough when the extension member is vertically disposed. Accordingly it would appear that the mechanism for both rotating and translating the extension member is something of an hinge-slider assembly.

A suitable holding means can be provided to maintain the extension member 2 in the horizontal position.

Figure 7:
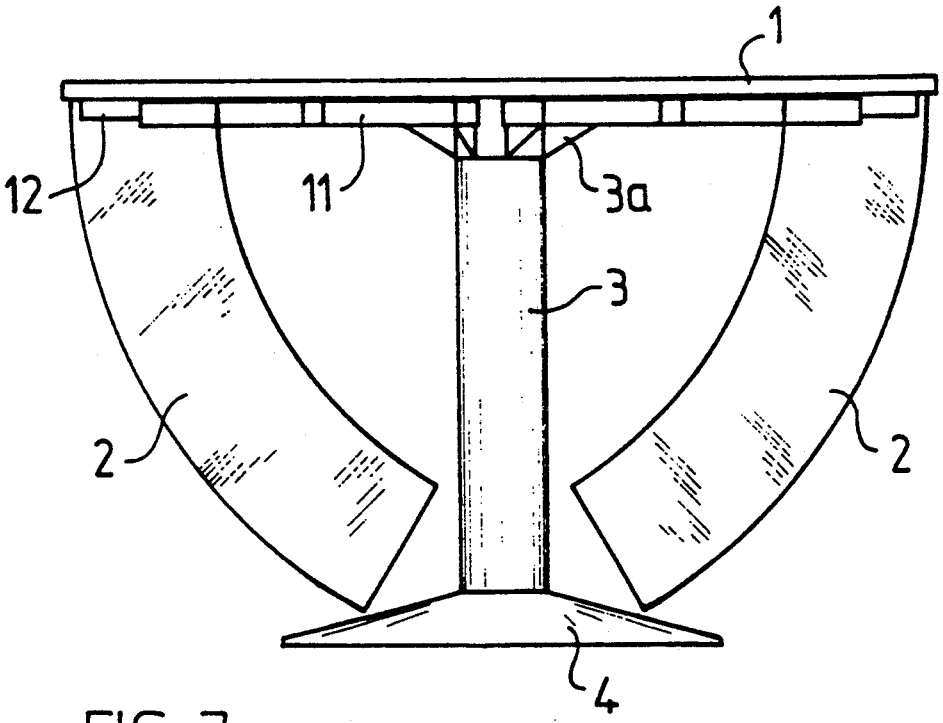
FIG. 7 is an alternative embodiment of the table assembly, the extension members thereof being stored under the table plate and locked by means of an assembly affixed onto the lower surface of the table plate.

In the alternative embodiment of FIG. 7, the locking of the extension members is carried out by sliding a rod 12 secured to the lower surface of each extension member into a guiding-holding member 11 affixed to a connection piece 3*a* secured to the table column 3.

Figure 8:
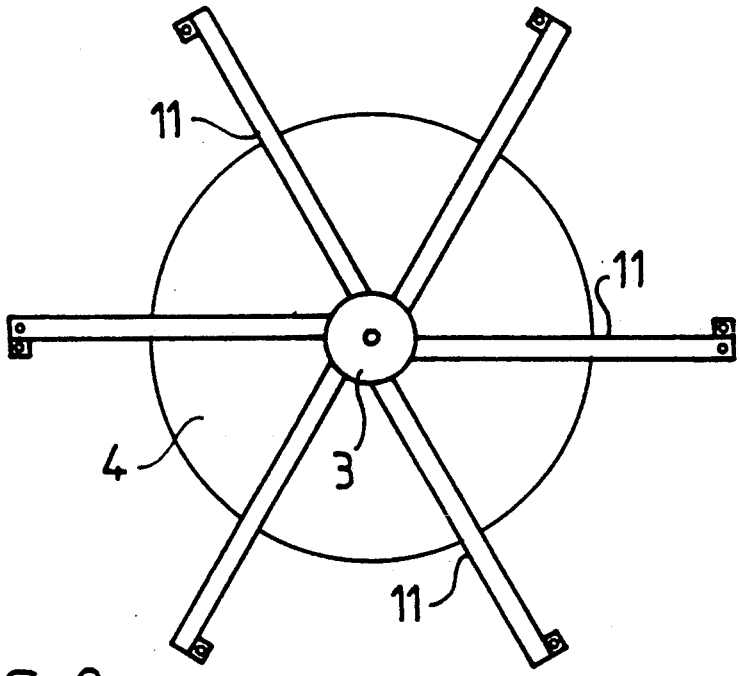
FIG. 8 is a top view of the locking assembly shown in FIG. 7, the table plate being removed.

As shown in FIG. 8, the guiding holding members are radially spaced apart from each other by 60°.

The various components of the inventive table assembly may be made of any material having the properties required for the use as regards the mechanical strength and the stability against chemicals.

Besides, the extension members may be vertically blocked by any locking system either on the column-basement assembly or on the table plate. Further provision could be made of a built-up structure which could be so arranged as, for example, cooperate with a telescopic mechanism mounted within the central column.

It should further be apparent to those skilled in the art that various changes in form and details may be made in the system as described. It is intended that such changes be included within the spirit and scope of the claims appended hereto.

What we claim is:

1. A table assembly comprising:

a substantially horizontally arranged table plate having an outer circumferential periphery and a lower surface;

supporting means for supporting the table plate;

a plurality of extension members mounted on said table plate, each of said extension members having side surfaces;

translating and pivoting means for permitting the extension members to be translated radially inwardly and outwardly with respect to a center of the table plate and pivoted from a first position in which they are substantially coplanar with the table plate so that the side surfaces of adjacent extension members face one another to a second position in which they are substantially vertically disposed relative to and underneath the horizontally disposed table plate so that one of said side surfaces of the extension member faces the lower surface of the table plate; and holding means for holding the extension members in the first position.

2. The table assembly according to claim 1, including locking means for locking each of said extension members in said second position.

3. The table assembly according to claim 2, wherein said locking means includes a plurality of recesses formed in said supporting member, each of said recesses being associated with one of said extension members for receiving a portion of the respective extension member when the extension member is moved to the second position.

4. The table assembly according to claim 2, wherein said translating and pivoting means includes an axle member connected to a lower surface of each extension member and a plurality of tubular members connected to the lower surface of the table plate, each of said tubular members receiving the axle member connected to one of the extension members.

5. The table assembly according to claim 4, wherein each of said tubular members has a slot that extends along the length thereof so that the tubular members are open along one side.

6. The table assembly according to claim 5, wherein each of said axle members includes stop means for preventing the axle member from being completely withdrawn from the respective tubular member when the extension member is in the first position so that the extension member cannot be dismounted from the table plate, said stop means being aligned with the slot in the respective tubular member when the extension member is in the second position for permitting the axle member to be completely withdrawn from the respective tubular member so that the extension member can be dismounted from the table plate.

7. The table assembly according to claim 6, wherein said stop means includes a pin extending outwardly from an outer surface of the axle member at a distal end of the respective axle member.

8. The table assembly according to claim 7, wherein said pin lies in a plane that is transverse to a plane containing the respective extension member.

9. The table assembly according to claim 2, wherein said locking means includes a plurality of spaced apart guide members extending radially outwardly from the center of the table plate, each of said guide members being associated with one of said extension members and receiving a rod secured to a lower surface of the respective exterior member.

10. The table assembly according to claim 9, including six guide members connected to said supporting means and spaced apart from one another at substantially equal intervals of 60°.

11. The table assembly according to claim 1, wherein said table plate is circular.

12. The table assembly according to claim 1, wherein the side surfaces of the extension members are rectilinear and wherein an inner peripheral surface and an oppositely positioned outer peripheral surface of the extension members are curvilinear, said inner peripheral surface of the extension members facing the outer peripheral surface of the table plate when the exterior members are in the first position.

* * * * *